United States Patent [19]

Lutz et al.

[11] 4,034,261

[45] July 5, 1977

[54] GRIDDED CROSSED-FIELD TUBE

[75] Inventors: Michael A. Lutz, Livermore; Robin J. Harvey, Thousand Oaks, both of Calif.

[73] Assignee: Hughes Aircraft Company, Culver City, Calif.

[22] Filed: Feb. 19, 1976

[21] Appl. No.: 659,605

[52] U.S. Cl. ..... 315/344; 313/161; 313/162; 313/198; 315/267

[51] Int. Cl.[2] ..... H01J 17/14; H01J 17/32

[58] Field of Search ..... 315/236, 267, 338, 344, 315/348; 313/161, 162, 198, 293, 294

[56] References Cited

UNITED STATES PATENTS

| | | | |
|---|---|---|---|
| 3,405,301 | 10/1968 | Hayakawa et al. | 313/162 |
| 3,581,142 | 5/1971 | Boxman | 313/162 |
| 3,714,510 | 1/1973 | Hofmann | 315/267 X |

*Primary Examiner*—Eugene R. La Roche
*Attorney, Agent, or Firm*—Allen A. Dicke, Jr.; W. H. MacAllister

[57] ABSTRACT

Three electrodes define two gaps in the crossed-field tube so that while one gap is holding off high voltage the other can be ignited to turn the tube on with high voltage applied. The three electrodes act as anode, cathode and control electrodes and define the main and ignition gaps. The intermediate electrode is gridded and the control electrode is connected to one of the other electrodes through an impedance to prevent hollow cathode discharge.

11 Claims, 5 Drawing Figures

GRIDDED CROSSED-FIELD TUBE

CROSS REFERENCE

This is an improvement on the invention claimed in Michael A. Lutz, Ser. No. 659,604 filed Feb. 19, 1976 concurrently herewith entitled Gridded Crossed-Field Tube and Ignition Method.

BACKGROUND

This invention is directed to improvements in a crossed-field switch device whereby the crossed-field switch device can be onswitched with voltage applied without pulsing the magnetic field to a high value.

In recent years crossed-field switch devices have been developed into tubes which are capable of conducting fairly high currents and are capable of off-switching against high voltages. Crossed-field switch devices having a 10,000 ampere DC conducting capability and an offswitching capability against 100 kilovolts have been designed. Such switch devices are believed to have a considerable prospect in the developing field of high power electric transmission by means of direct current links. Such crossed-field switch devices do not have long term conducting capability, and thus must be paralleled by an in-line switch during normal line operation. When it is desired to open the circuit, the in-line switch is opened, so that it shunts the current through the crossed-field switch device which is thereupon turned off. U.S. Pat. No. Re. 27,557 illustrates this type of circuit breaker which incorporates a crossed-field switch device as an off-switching component.

There have been a number of developments in the art of the crossed-field switch device which have brought it to this state of utility. Among the background patents on the crossed-field switch devices are U.S. Pat. Nos. 3,638,061; 3,641,384; 3,604,977; 3,558,960; 3,678,289; 3,769,537 and 3,749,978.

Of course it is necessary to onswitch the crossed-field switch device when current flow therethrough is required. Under the right conditions of applied voltage and magnetic field, initial ionization can come about by the action of cosmic rays. However, in order to reduce the statistical reliance on such events, ignition devices can supply the preionization, (see U.S. Pat. Nos. 3,714,510 and 3,890,520). These patents covering ignition equipment are useful to reduce the ignition time delay whenever the conditions are within the conductive region of the Paschen curve.

Sometimes it is desired to make the crossed-field switch device conductive, that is onswitch the switch device, when the rated line voltage is applied thereacross. This has formerly been done by pulsing the magnetic field sufficiently high that even with voltage applied, the conditions in the interelectrode space move into the conductive region. For example see U.S. Pat. Nos. 3,678,289 and 3,604,977.

However, the firing or ignition of a crossed-field switch device at high voltage using a high pulse magnetic field has several disadvantages. There is a time delay from the trigger to the ignition of the crossed-field switch device in the order of 10 microseconds. Furthermore, there is significant jitter in ignition, in the order of 1 microsecond. Additionally, it is difficult to obtain short duration, high level magnetic pulses in the order of 0.1 Tesla or 1 K Gauss in crossed-field switch devices due to the eddy currents created in the electrodes. Also, a high powered magnetic field pulser is a difficult and expensive device, particularly at a high pulse repetition frequency. These requirements also create a more complicated and expensive tube construction which often includes an internal magnetic field coil to minimize the above listed detrimental effects. Thus, it is highly desirable for a crossed-field switch device to be ignited at high voltage, in the order of 10 to 100 kilovolts, with a relatively low magnetic field, in the order of 0.01 Tesla, or 100 Gauss.

SUMMARY

In order to aid in the understanding of this invention it can be stated in essentially summary form that it is directed to a gridded crossed-field switch device. The crossed-field switch device has anode, cathode and control electrodes which define a main gap and an ignition gap. The control electrode is connected through an impedance to one of the other electrodes to prevent hollow cathode discharge in the control gap. The control gap can be pulsed to ignite and the plasma passes through the intermediate electrode into the main gap to cause its ignition into the low pressure glow mode.

It is thus an object of this invention to provide an improved gridded crossed-field switch which can be onswitched while high voltage is applied without the need for a large magnetic field pulse. It is another object to provide a crossed-field switch device which has three electrodes, which define an ignition gap and a main conducting gap so that ignition can be accomplished within the ignition gap. It is a further object to provide a connection of proper impedance between the control electrode and another electrode to permit pulsing of the control electrode for ignition and to prevent the initiation of hollow cathode discharge in the control gap. It is another object to provide an intermediate electrode which is of gridded construction with openings directly therethrough so that the ignition gap and main gap are in line of sight. It is a further object to provide a three electrode crossed-field switch device in which the main gap can be ignited to operate in the crossed-field discharge mode without requiring a pulsed magnetic field.

Other objects and advantages of this invention will become apparent from a study of the following portion of the the specification, the claims and the attached drawings.

DESCRIPTION OF THE PREFERRED EMBODIMENT

Figure 1:
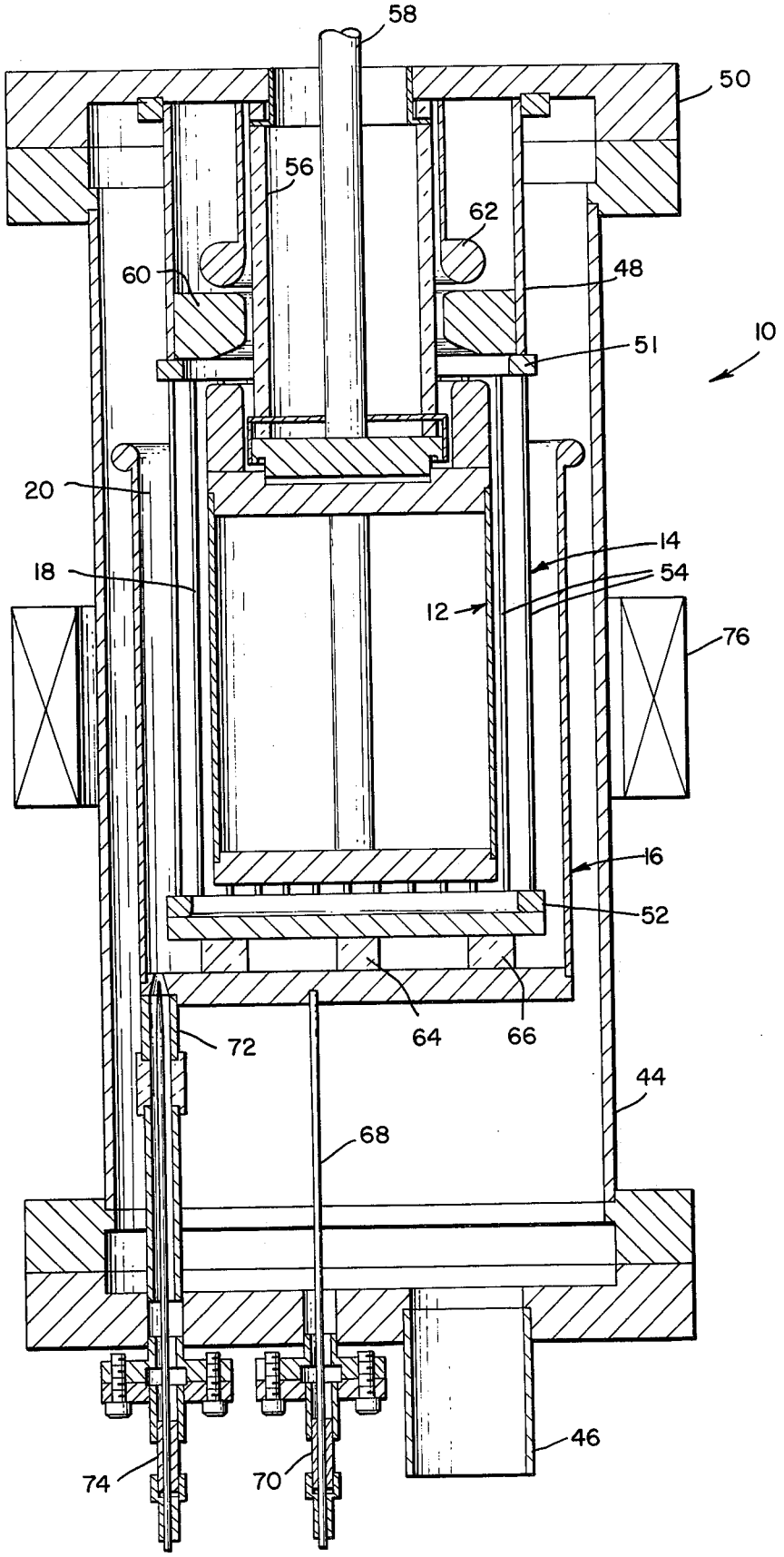
FIG. 1 is a longitudinal section through the gridded crossed-field switch device of this invention.
Figure 3:
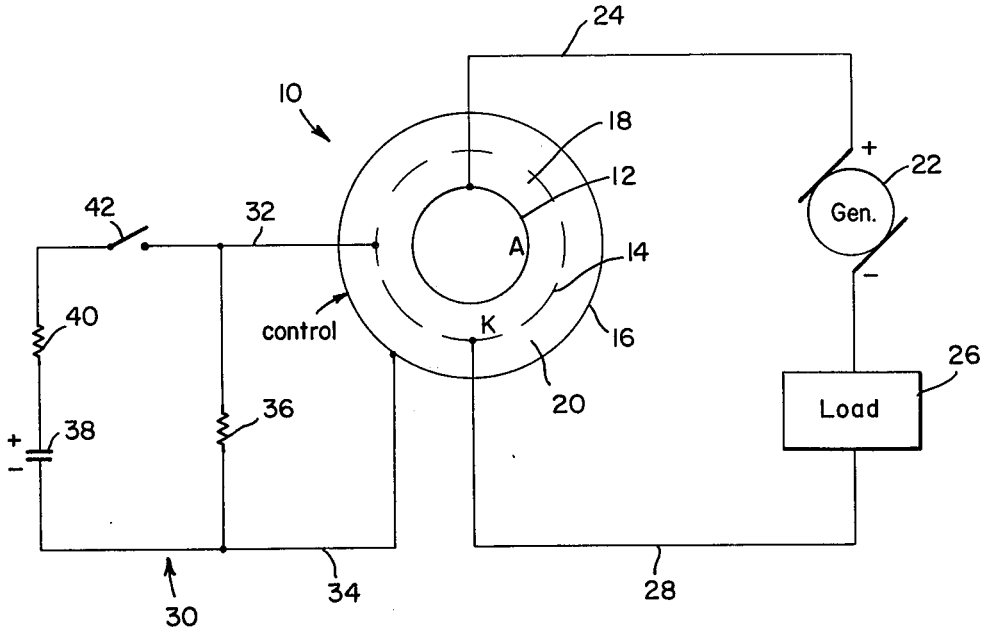
FIG. 3 is a schematic electrical diagram showing the connections of the gridded crossed-field switch device.

The gridded crossed-field switch device of this invention is generally indicated at 10 in FIGS. 1 and 3. In the schematic drawing of FIG. 3, crossed-field switch device 10 is shown as having an anode electrode 12, a cathode electrode 14 and a control electrode 16. As will be described below, the physical arrangement of the electrodes may differ, with the control electrode between the cathode and anode or even interiorly of the anode, but the preferred arrangement is as shown in FIG. 3. These concentric electrodes define an annular space or gap 18 between the anode and cathode, with the annular space 18 serving as a main gap in which the main glow discharge is formed during conduction. Cathode electrode 14 and control electrode 16 define between them outer annular space 20 which is the gap in which the ignition discharge is formed. Space 18 and space 20 are each in the order of 1 centimeter in the radial direction. While the crossed-field switch device is shown as being circular, because that is a convenient construction, other geometric constructions are also feasible, so that the gap may not be a circular annulus but may be another shape such as a hollow rectangle or a hollow square. Cathode electrode 14 has openings therethrough so that the plasma of a glow discharge in one of the spaces can enter into the other space. Since cathode electrode 14 is positioned between anode electrode 12 and control electrode 16, it is necessarily open so that the plasma can pass from the ignition gap to the main gap. The intermediate electrode has openings therethrough which provide line of sight visibility between the ignition gap and main gap.

As is seen in FIG. 3 the positive side of generator 22 is connected by line 24 to anode 12, while the negative side of generator 22 is connected through load 26 by line 28 to cathode 4. Thus, the turning on and off of a low pressure glow discharge in the main discharge gap 18 turns on and off current from the generator through the load. Of course FIG. 3 is highly schematic, and the generator 22 represents any source of direct current. Furthermore, the switching on and off of the current through the load is not usually accomplished only by the gridded crossed-field switch device 10 but also by parallel in-line device through which the current passes during long running periods.

Control circuit 30 has line 32 connected to cathode electrode 14 and line 34 connected to the control electrode 16. Resistor 36 is connected between lines 32 and 34 so that unless an additional voltage is supplied, control electrode 16 is at the same potential as cathode 14, by the leakage through the resistor 36. When resistor 36 is of low value, the electrodes can carry substantially the same potential and a hollow cathode discharge will continue in gap 20 so device 10 cannot be turned off. When resistor 36 is of too high a value the potential of the control electrode 16 can not be properly established prior to the initial start of the magnetic field pulse and spurious turn on may result. A resistance value between 1 kilohm and 1 megohm typically satisfies both of these requirements. Control circuit 30 permits voltage pulsing of control electrode 16 with respect to cathode 14. As an example, capacitor 38, capacitor discharge rate limiting resistor 40 and switch 42 are serially connected between lines 34 and 32. Another type of pulse supply can be substituted. A pulse on the order of 1 kilovolt is typical but voltages as low as 300V are feasible.

Figure 2:
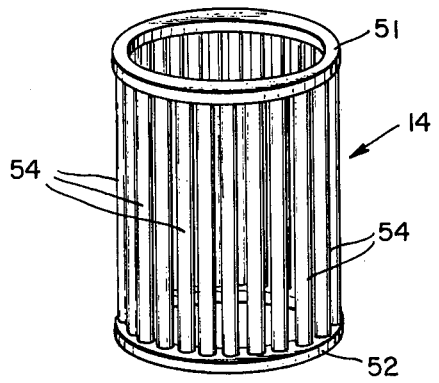
FIG. 2 is a perspective view of one of the electrodes.

FIG. 1 shows in more detail the structure of the gridded crossed-field switch device 10. Outer vessel 44 is the structural enclosure, tank or envelope which encloses the electrodes and their insulated supports. Vessel 44 is vacuum tight with connection 46 permitting drawing of a vacuum on the vessel and maintenance of a proper gas supply therein at a proper pressure. Usually helium at about 50 millitorr is a suitable atmosphere for the low pressure glow crossed-field discharge. Vessel 44 is at cathode potential. It supports cathode 14 on support ring 48 downward from top cover 50. Cathode electrode 14 is formed as a grid or perforated electrode. FIG. 2 shows cathode 14 as being formed of an upper ring 51, lower ring 52 and bars 54 connected therebetween to form an electrode in the form of a squirrel cage. The squirrel cage intermediate electrode provides a line of sight between the two gaps so that plasma from the ignition gap can easily pass into the main gap.

Anode 12 is downwardly supported from upper ring 50 on insulator 56 and is exteriorly connected by lead 58 which is connected to line 24. Insulator 56 is the major insulator which holds off the main anode to cathode voltage. Insulator 56 is supplied with field shaping electrodes 60 and 62 to prevent glow discharge breakdown in that region.

Control electrode 16 is supported beneath cathode 14 on insulators such as the ones shown at 64 and 66. Control electrode 16 is connected by lead 68 which passes through a vacuum tight insulator 70 with respect to vessel 44.

Ionizer 72 is mounted to inject electrons into the outer annular space 20 and its lead comes out through the base by means of a vacuum tight insulator 74. Ionizer 72 can be of the type shown in U.S. Pat. No. 3,890,520.

Figure 5:
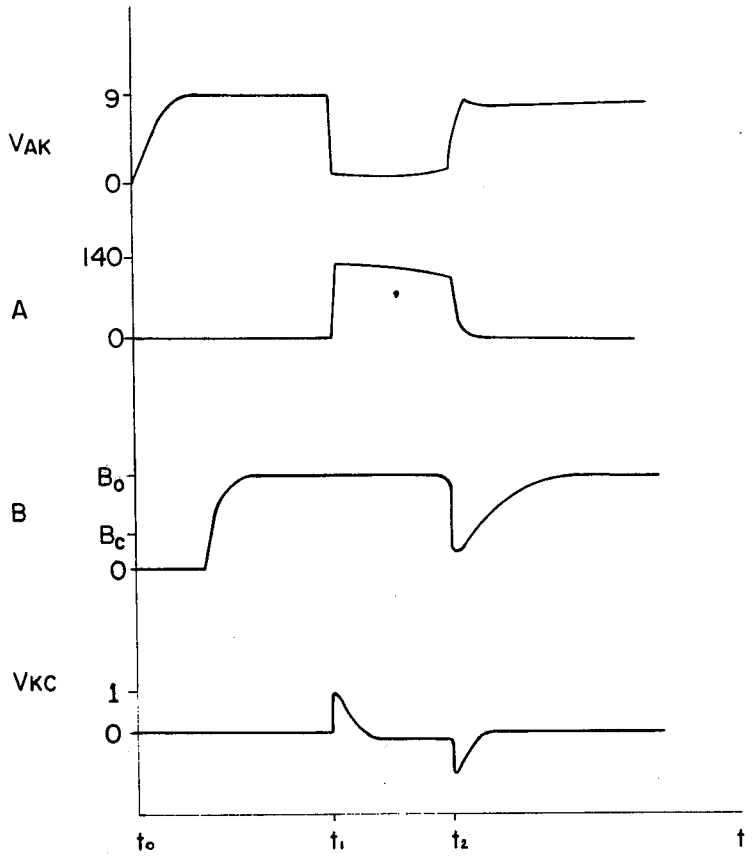
FIG. 5 is a series of graphs showing various parameters in the gridded crossed-field switch device versus time.
Figure 4:
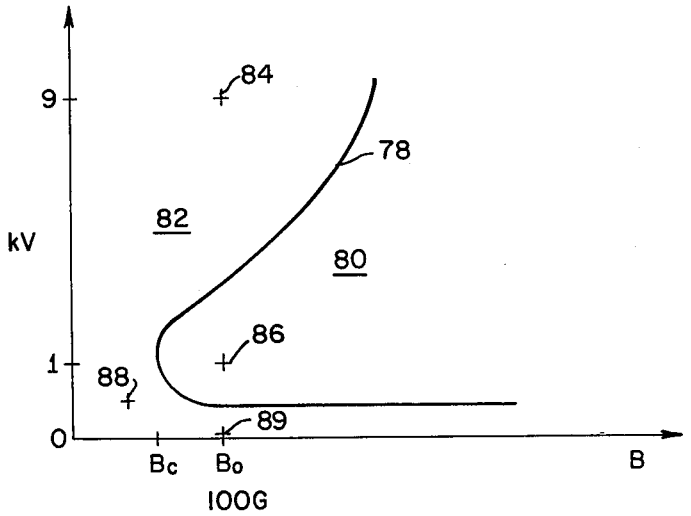
FIG. 4 is a crossed-field breakdown curve relating the conditions in the interelectrode gaps to the conductive region of the breakdown curve.

In accordance with the physical mechanism by which the discharge operates, an axial magnetic field is provided by solenoid 76. The magnetic field has a value of $B_0$ as shown in FIGS. 4 and 5, which is on the order of 100 gauss for an interelectrode spacing of 1–2 centimeters and with a helium gas filling at 50 millitorr. The magnetic field can be pulsed below the critical value $B_C$, (see FIGS. 4 and 5) which is the leftward end of the toe of the crossed-field breakdown curve 78 which separates the conductive region 80 from the nonconductive region 82.

The function of this equipment is best described by going through an on-off cycle. Referring to FIG. 5, at time $t_0$, 9 kilovolts is first applied to the main gap 18 and a magnetic field of strength $B_0$ is then applied to both gaps. This places the operating condition of the main gap at a point 84 in FIG. 4. This is in the nonconductive region and therefore no current is being conducted by the gridded crossed-field switch device 10. Since control electrode 16 is connected to cathode electrode 14 through leak resistor 36, the voltage of the control electrode C with respect to the cathode K is zero. This places the operating condition of the control gap at point 89 in FIG. 4.

When on-switching is desired, for example at point $t_1$, the switch 42 is closed to impress a pulse between the cathode K and the control electrode C to bring the voltage therebetween into the conductive region of the crossed-field breakdown curve, for example to point 86 in FIG. 4 which represents about 1 kilovolt between the cathode and the control electrode. Under these conditions, a discharge in the control gap initiates. With that gap conducting in the low pressure glow discharge mode, the discharge plasma seeps through the transmissive cathode structure to cause conduction of the main gap 18. The mechanism by which the conduction starts is not clearly understood, because under the initial conditions the gap is in an unconducting region at point 84. However, the presence of glow discharge plasma, which does not seem to need to be sufficient to reach across the entire gap, starts the main gap discharge. With the beginning of that discharge, within microseconds after the on-pulse, and thus both indicated at time $t_1$ in FIG. 5, the main gap conduction current increases to 140A and the voltage across the main gap decreases to the discharge voltage drop, typically 500V.

Conduction continues either to exhaustion of the interelectrode gas, or until magnetic field is suppressed. As is seen in the bottom curve in FIG. 5, the voltage across the ignition gap quickly falls to a lower value, due to conduction through impedance 36, and the disipation of the charge on capacitor 38. Conduction continues to take place from the anode to both the cathode and the control electrode. Off-switching is then accomplished by pulsing the magnetic field below $B_c$. This pulsing appears at time $t_2$ in FIG. 5 and moves the operating point to point 88 which is in the nonconductive region 82 of the crossed-field breakdown curve of FIG. 4. This causes termination of the main gap discharge with a buildup of voltage between the anode and cathode and between the cathode and the control electrode and a termination of the current flow therebetween. Finally current flow through resistor 36 ceases and the control electrode comes to the potential of the cathode and the magnetic field is then reapplied. In this way the on-off cycle is completed.

The squirrel cage type of structure shown in FIG. 2 is an example of a preferred structure. Basically, cathode electrode 14 must have sufficient material to develop the electric field and participate in the discharge. However, it must be open enough to permit the glow discharge plasma to seep through from the outer ignition discharge gap to the main gap. A perforated tube can accomplish the same result. The preferred maximum open area has not yet been experimentally established, however the cathode electrode 14 of about 30 percent open area has been found to be feasible.

In the device actually reduced to practice, resistor 36 was about 1 kilohm and such a resistor seemed to be necessary to produce the correct discharge. FIG. 5 illustrates the maximum voltage applied as being 9 kilovolts, but the limitation to this value was introduced by the isolation resistors between the electrodes rather than a fundamental limitation of the physical process. In fact, ignition at 50 kV has been performed in the above described manner.

Several references has been made to prior patents and other disclosures. These references are incorporated into this specification in their entirety by this reference. This invention having been described as preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A crossed-field switch device comprising:

a tubular anode electrode and a tubular cathode electrode spaced from said anode electrode the active areas thereof defining and facing a main discharge gap having therebetween a continuous closed path and means for making electrical connections to said anode and said cathode electrodes and means for providing a gas at sub-atmospheric pressure in said main discharge gap and a magnetic field above the critical value in said main discharge gap so that a glow mode plasma discharge can take place between said anode and said cathode electrodes for conduction of said switch device, the improvement comprising:

a tubular control electrode positioned adjacent to one of said anode and cathode electrodes to form a continuous closed path ignition discharge gap adjacent to, substantially over the whole active area of and in communication with said main discharge gap, the electrode between said main gap and said ignition discharge gap being an intermediate electrode, said intermediate electrode having openings therethrough so that there is a line of sight between said main gap and said ignition gap so that plasma can pass from said ignition gap to said main gap; and means for electrically pulsing said control electrode with respect to its adjacent electrode on the other side of said ignition discharge gap for bringing conditions in said ignition discharge gap into conductive conditions so that glow mode plasma discharge begins in said ignition discharge gap and enters into substantially the entire active area of said main discharge gap through said intermediate electrode to cause conductive condition of said main discharge gap so that said crossed-field switch device can be turned on with voltage applied thereto without magnetic field pulsing and with uniform wear of said anode and cathode electrodes over their entire active areas.

2. The crossed-field switch device of claim 1 wherein said cathode electrode and said control electrode are both exterior of said anode electrode.

3. The crossed-field switch device of claim 2 wherein said control electrode is exteriorly positioned to both said cathode electrode and said anode electrode.

4. The crossed-field switch device of claim 3 wherein said electrodes are in the form of coaxially positioned cylindrical tubes so that said gaps are annular gaps.

5. The crossed-field switch device of claim 1 wherein said anode electrode and said cathode electrode are both positioned interiorly of said control electrode.

6. A crossed-field switch device comprising:

a tubular anode electrode and a tubular cathode electrode spaced from said anode electrode to form a continuous closed path main discharge gap therebetween and means for making electrical connections to said anode and said cathode electrodes and means for providing a sub-atmospheric gas pressure in said main discharge gap and a magnetic field above the critical value in said main discharge gap so that a glow mode plasma discharge can take place between said anode and said cathode electrodes for conduction of said switch device, a control electrode positioned adjacent to one of said anode and cathode electrodes to form an ignition discharge gap adjacent to and in communication with said main discharge gap, means for electrically pulsing said control electrode with respect to said adjacent electrode on the other side of said ignition discharge gap for bringing conditions in said ignition discharge gap into conductive condition, the improvement comprising:

an impedance connected between said control electrode and its adjacent electrode on the other side of said ignition discharge gap, said impedance being sufficiently high so hat said means for electrically pulsing can bring said control electrode to ignition potential and so that after glow mode plasma discharge begins in the ignition discharge gap, hollow cathode mode discharge is not sustained and said impedance is sufficiently low so that said control electrode is held at said cathode potential when the device is in the off state.

7. The crossed-field switch device of claim 6 wherein said cathode electrode and said control electrode are both exterior of said anode electrode.

8. The crossed-field switch device of claim 7 wherein said control electrode is exteriorly positioned to both said cathode electrode and said anode electrode.

9. The crossed-field switch device of claim 6 wherein said anode electrode and said cathode electrode are both positioned interiorly of said control electrode.

10. The crossed-field switch device of claim 9 where said control electrode forms the outermost electorde, said anode electrode forms the inner electrode and said cathode electrode is positioned between said anode electrode and said control electrode to form on its interior said main discharge gap and on its exterior said ignition discharge gap.

11. The crossed-field switch device of claim 6 wherein said electrode which acts in association with both said ignition gap and said main gap has openings therethrough to permit passage of glow mode discharge plasma from said ignition discharge gap to said main discharge gap.

* * * * *